US007465868B2

(12) United States Patent
Lengeling

(10) Patent No.: US 7,465,868 B2
(45) Date of Patent: Dec. 16, 2008

(54) FRAMELESS MUSICAL KEYBOARD

(75) Inventor: Gerhard Lengeling, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 178 days.

(21) Appl. No.: 11/148,536

(22) Filed: Jun. 8, 2005

(65) Prior Publication Data

US 2006/0278058 A1 Dec. 14, 2006

(51) Int. Cl.
*G10H 1/32* (2006.01)

(52) U.S. Cl. ..... 84/719; 84/718; 84/720; 84/743; 84/744; 84/745

(58) Field of Classification Search ..... None
See application file for complete search history.

(56) References Cited

U.S. PATENT DOCUMENTS

| | | | | |
|---|---|---|---|---|
| 5,463,925 | A * | 11/1995 | Galocy | 84/423 R |
| 6,008,551 | A * | 12/1999 | Coray | 307/157 |
| 6,259,006 | B1 | 7/2001 | Parienti | |
| 6,875,913 | B2 * | 4/2005 | Bubar | 84/423 R |
| 2002/0073826 | A1 * | 6/2002 | Fiks et al. | 84/477 R |
| 2003/0056634 | A1 * | 3/2003 | Asahi | 84/17 |
| 2004/0083877 | A1 * | 5/2004 | Bubar | 84/423 R |
| 2005/0034591 | A1 * | 2/2005 | Chang | 84/730 |
| 2005/0257665 | A1 * | 11/2005 | Kerkhoff | 84/471 SR |

* cited by examiner

*Primary Examiner*—Marlon T Fletcher
(74) *Attorney, Agent, or Firm*—Blakely, Sokoloff, Taylor & Zafman LLP

(57) ABSTRACT

Embodiments of an electronic, frameless, musical keyboard with the ability to couple to other frameless musical keyboards are described. In one embodiment, a first musical keyboard section includes an arrangement of black and white keys, similar to a layout of a piano keyboard, disposed over a base. The keys at the left and/or right sides of the keyboard section have exposed sides, so that a second keyboard section can be integrated with the first keyboard section to give the appearance of a single keyboard. To integrate the first keyboard section with the second keyboard section, the base of the first keyboard section extends past the right-most key to a width and length that is substantially equal to the dimensions of a left-most key from the second keyboard section. The left-most key can then be laid to rest over the extended base portion. The reserved space formed by the base of the first keyboard section having dimensions of a key (e.g., a standard white key of a piano keyboard) allows for consistent integration of another keyboard section (having any number of keys) with the first keyboard section.

29 Claims, 6 Drawing Sheets

FRAMELESS MUSICAL KEYBOARD

TECHNICAL FIELD

The invention relates generally to electronic devices for producing musical sounds, and in one embodiment, a musical keyboard that can integrate with additional musical keyboards to form a larger musical keyboard.

BACKGROUND

The affordability and accessibility of electronic keyboards make them a popular alternative to traditional, acoustic keyboard instruments, such as full-size pianos. Electronic keyboards can cover most, if not all, of the popular acoustic and electronic instrument sounds. The main difference between electronic keyboards and acoustic keyboards is that the sound created does not come from the physical movement of a string. In an acoustic piano, pressing a key causes a hammer to drop down and strike one or more strings, and the string vibration sets the surrounding air into motion, creating sound waves. The sound from an electronic keyboard comes from continuously changing electrical signals (analog) or a stream of numbers generated by a microprocessor (digital). The electrical signal of analog instruments is heard through loud speakers which convert the changes in electrical polarity to air movement, resulting in sound. Digital instruments work similarly, but the stream of numbers must first be converted into a continuous electrical signal by an internal component referred to as a digital-to-analog converter (DAC).

Electronic keyboards are also much smaller and lighter, making them ideal for portable use. They can also be connected to a computer and integrated with software to compose, record, and playback music. FIG. 1 illustrates a top view of a conventional electronic keyboard that includes a frame that surrounds a number of black and white keys. The keyboard is also equipped with various knobs, buttons, rockers switches, and other types of controllers to manipulate modulation, pitch bend, and octave. These controller buttons are typically positioned on the frame around the keys for easy access by the user.

To enhance portability, current electronic keyboards have fewer keys relative to the full 88 keys of conventional pianos. However, electronic keyboards are limited to how small they can be, because keys have standard sizes comparable to piano keys, and a shorter keyboard limits what can be played. The number of keys on a conventional portable keyboard can vary, but typically have enough keys to provide a range between 2 to 5 octaves. As the number of keys on an electronic keyboard increases, the portability of the keyboard decreases because of size and weight considerations. U.S. Pat. No. 6,259,006 to Parienti ("the '006 patent") describes a portable foldable electronic piano made of multiple sections that are evenly sized, and joined together by a flexible membrane. When folded, the sections stack on top of each other with a length and width of one section. One disadvantage of the '006 patent keyboard is that the overall size of the keyboard and the number of keys available to a user, when unfolded, is pre-set. In order for the '006 patent keyboard to be operational, all the keyboard sections must be unfolded. Because the keyboard sections are physically attached together when folded or unfolded, there is no option to remove or add keyboard sections. This limits the type of music can be played with the keyboard, based on the number of keys and octaves available.

SUMMARY

Embodiments of an electric, frameless, musical keyboard with the ability to couple to other musical keyboards such as frameless musical keyboards are described. In one embodiment, a first musical keyboard section includes an arrangement of black and white keys, similar to a layout of a piano keyboard, disposed over a base. The keys at the left and/or right sides of the keyboard section have exposed sides, so that at least a second keyboard section can be integrated with the first keyboard section to give the appearance of a single keyboard. To integrate the first keyboard section with the second keyboard section, the base of the first keyboard section, in one exemplary embodiment, extends past the right-most key to a width and length that are substantially equal to the dimensions of a left-most key from the second keyboard section. The left-most key can then be laid to rest over the extended base portion. The reserved space formed by the base of the first keyboard section having dimensions of a key (e.g., a standard white key of a piano keyboard) allows for consistent integration of another keyboard section (having any number of keys) with the first keyboard section. In certain embodiments, each keyboard section may be used as a peripheral to a data processing system (e.g., a computer) and/or may be used as a standalone device which can play music and/or sounds.

Any number of keyboard sections can be coupled together to provide a musical keyboard having a wide range of key arrangements corresponding to a range of octaves, for example, equivalent to a full size piano keyboard. The integrated musical keyboard can be electrically connected with wired or wireless connectivity. Optionally, a single section keyboard or a multi-section keyboard can also be configured for connectivity to a desktop or notebook computer. When not in use, the multi-section keyboard can be separated completely into individual sections, allowing for ease of transport or storage.

There are numerous other embodiments which are described herein, and these embodiments generally relate to musical keyboards that can be integrated together to form larger keyboards.

BRIEF DESCRIPTION OF THE DRAWINGS

The present invention is illustrated by way of example, and not limitation, in the figures of the accompanying drawings in which.

DETAILED DESCRIPTION

Figure 1:
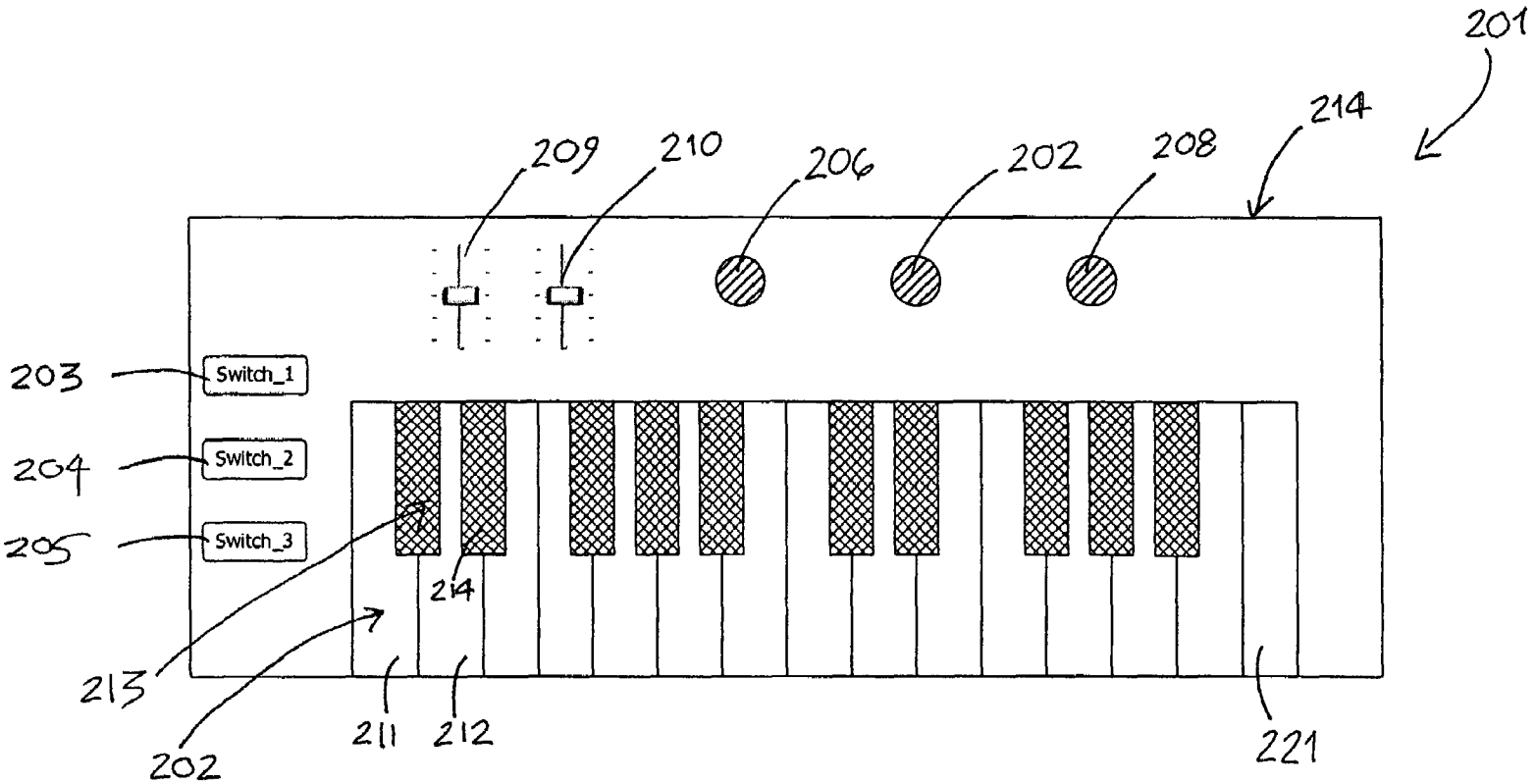
FIG. 1 illustrates a top view of a conventional electronic keyboard.

In the following description, numerous specific details are set forth such as examples of specific, components, circuits, processes, etc. in order to provide a thorough understanding of the present invention. It will be apparent, however, to one skilled in the art that these specific details need not be employed to practice the present invention. In other instances, well known components or methods have not been described in detail in order to avoid unnecessarily obscuring the present invention.

Embodiments of a portable musical keyboard are described. In one embodiment, the musical keyboard can integrate with additional musical keyboards to form a multi-section keyboard but with the appearance of a single keyboard. In one embodiment, a first musical keyboard section includes an arrangement of black and white keys, similar to a layout of a piano keyboard, disposed over a base and within a frameless structure. It will be understood that the terms "black key" and "white key" are not meant to refer to the color of the key but rather are meant to refer to the type of key found on a conventional piano keyboard. As is well known in the art, the black keys are shorter and narrower than the white keys on a conventional piano keyboard, and there are five (5) black keys within an octave and eight (8) white keys within an octave. Thus, in certain embodiments of keyboard sections made according to the invention, the keys on such keyboard sections may have colors other than black and/or white but they may still be considered to be black keys and/or white keys based on the type of key. The keys near the left and/or right sides of the first keyboard section have exposed sides, so that a second keyboard section can be integrated with the first keyboard section to give the appearance of a single keyboard, when combined. Alternatively, the sides of the keyboard section can have a very thin frame so that when a second keyboard section is integrated, the combined keyboard gives the appearance of a single keyboard. To integrate the first keyboard section with the second keyboard section, the base of the first keyboard section, in at least certain embodiments, extends past the right-most key to a width and length that are substantially equal to the dimensions of a left-most key from the second keyboard section. The left-most key can then be laid to rest over the extended base portion of the first keyboard section. The reserved space formed by the base of the first keyboard section, having dimensions of a piano key (e.g., a standard white key of a piano keyboard), allows for a consistent and seamless integration with the second keyboard section (which can have dimensions similar to the first keyboard section) or with multiple keyboard sections. It will be appreciated that other techniques may alternatively be used to join keyboard sections which have their leftmost and/or rightmost keys exposed on the sides of these keys. Any number of keyboard sections can be coupled together to provide a musical keyboard having a wide range of key arrangements corresponding to a range of octaves, for example, equivalent to a full size piano keyboard. The integrated musical keyboard can be electrically connected with wired (e.g., Universal Serial Bus or "USB") or wireless (e.g., radiofrequency) connectivity. Optionally, a single section keyboard or a multi-section keyboard can also be configured for connectivity to a desktop or notebook computer. When not in use, the multi-section keyboard can be separated completely into individual sections, allowing for ease of transport or storage.

For clarity of explanation, embodiments of a portable, musical keyboard are described and illustrated with respect to an electronic, musical keyboard. It is understood that in alternative embodiments, other types of musical keyboards or musical instruments with keyboard arrangements may be used with the novel features of the present invention. It is also understood that FIGS. 2A-5 are not drawn to scale, and the relative dimensions of the physical structure should not be inferred from the relative dimensions shown in the drawings.

Figure 2A:
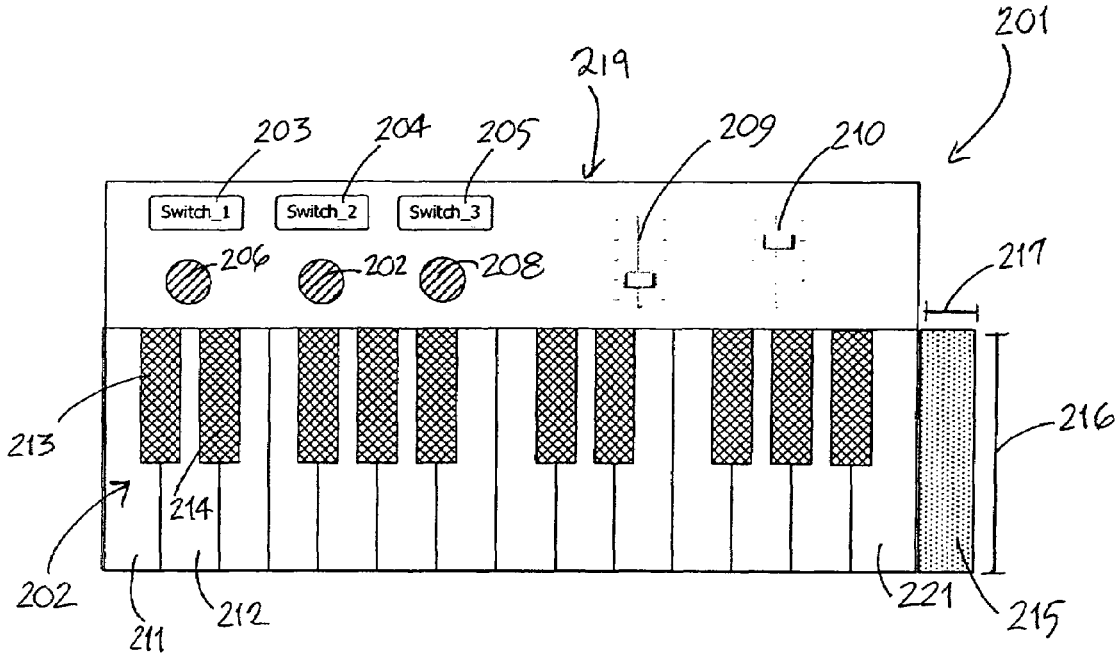
FIG. 2A illustrates a top view of one embodiment of a keyboard section having an array of white and black keys arranged together in a manner similar to a piano keyboard.
Figure 2B:
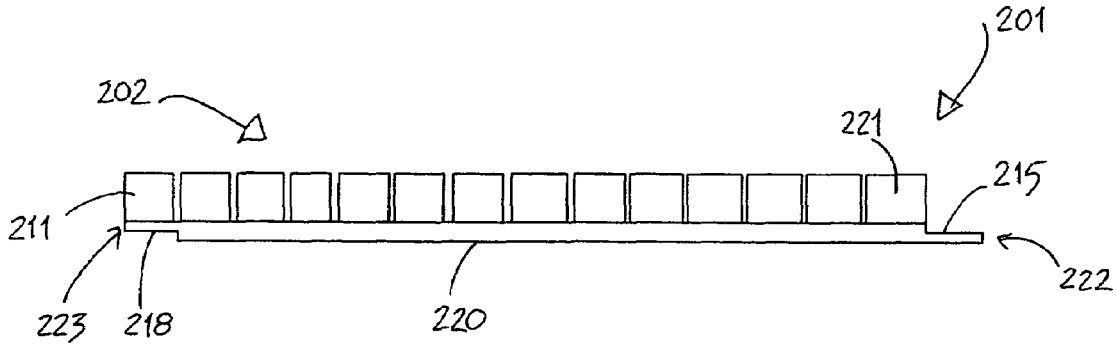
FIG. 2B illustrates a side view of the keyboard section of FIG. 2A.

FIGS. 2A-2B illustrate different views of one embodiment of a portable, musical keyboard section 201. The top view illustrated in FIG. 2A shows a key array 202 of white keys (e.g., 211, 212) and black keys (e.g., 213, 214) arranged together in a manner similar to a piano keyboard. For example, key 211 corresponds to a "C" note, key 212 corresponds to a "D" note, key 213 corresponds to a "C♯" (C sharp) note, and key 214 corresponds to a "E♭" (E flat) note. Key array 202 is disposed over base 220. In one exemplary embodiment, the dimensions of each key of key array 202 are also substantially similar to the dimensions of standard piano keys. For example, white key 211 has a length (the long side) and a width (the short side) substantially similar to a standard white key of a standard, full-size piano. Keyboard section 201 includes a front side, a backside, a left side, a right side, a top side, and a bottom side. The top side includes the top surface of the keys of key array 202. The bottom side includes the bottom surface of base 220 that is in physical contact with a surface to support keyboard section 201. Key array 202 is disposed over the top side of base 220. Base 220 also includes a front side, a backside, a left side, a right side, a top side, and a bottom side. In one embodiment, white keys 211, 212 and black keys 213, 214 have dimensions that are substantially similar to dimensions of keys on a standard piano keyboard. One feature of keyboard section 201 is that key array 202 is only partially framed by a housing structure. Although the keys are disposed over a base 220, as illustrated in the side view of FIG. 2B, the left and right sides of key array 202 are exposed and overall, key array 202 is enclosed only near the backside. A frame portion 219 extends from base 220 in a direction substantially parallel to the length of the black and white keys of key array 202.

Disposed on frame portion 219 is a number of switches (e.g., 203, 204, 205), dials (e.g., 206, 207, 208), and sliders (e.g., 209, 210) to control various keyboard functions during operation, such as volume level, modulation, pitch bend and octave up/down. Near the right side of key array 202, base 220 extends past the right-most key 221 to define a space 215 having dimensions that are substantially equal another white key. For example, the length 216 and width 217 of space 215 is substantially equal to the length and width of key 221. The base portion of space 215 is also undercut with a thickness 222. A space 218 is also formed by base 220 near left-most key 211. In particular, an undercut with length and width dimensions substantially similar to key 211 and a thickness 223 is formed in base 220. As described in greater detail below with respect to FIGS. 3A-3D, the dimensions of space 215 and/or 218 allow for one or more keyboard sections to be integrated with keyboard section 201 and give the appearance of a single keyboard. The additional keyboard sections can be added to one or both sides of keyboard section 201.

In one particular embodiment, musical keyboard section 201 has an arrangement of black and white keys similar to a piano key arrangement that begin with a C key near the left side (e.g., key 211) and ends with a B key near the right side (e.g., key 211), with a total of 11 white keys and 10 black keys. For example, the key order for white keys is C-D-E-F-G-A-B-C-D-E-F-G-A-B so that at least one octave stretches from the first C note to the second C note. The position where the third C note (e.g., from another keyboard section) would be located is occupied by space 215. As such, once a second keyboard is integrated with keyboard section 201, a range of at least two octaves are provided. Alone, keyboard section 201 is one key short of two full octaves. In one embodiment, an octave span for key array 202 is about 160 mm to about 170 mm to allow the fingers of a user to fit comfortably between keys and be familiar to trained keyboardists. In one particular embodiment, the octave span from one C note to the next C note is about 165 mm. In one embodiment, the overall dimensions musical keyboard section 201 may be similar to the dimensions of a 15-20 inch notebook computer. For example, the overall width of musical keyboard section 201 may be about 392 mm and the overall length may be about 259 mm.

Figure 3A:
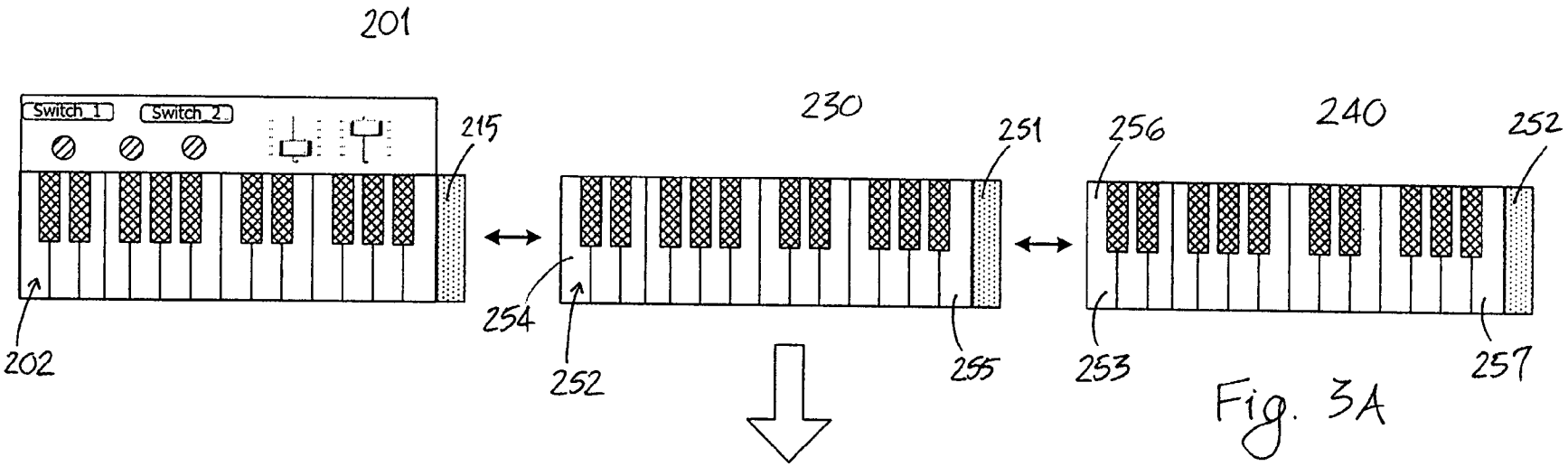
FIG. 3A illustrates a top view of one embodiment of an integrated keyboard.
Figure 3B:
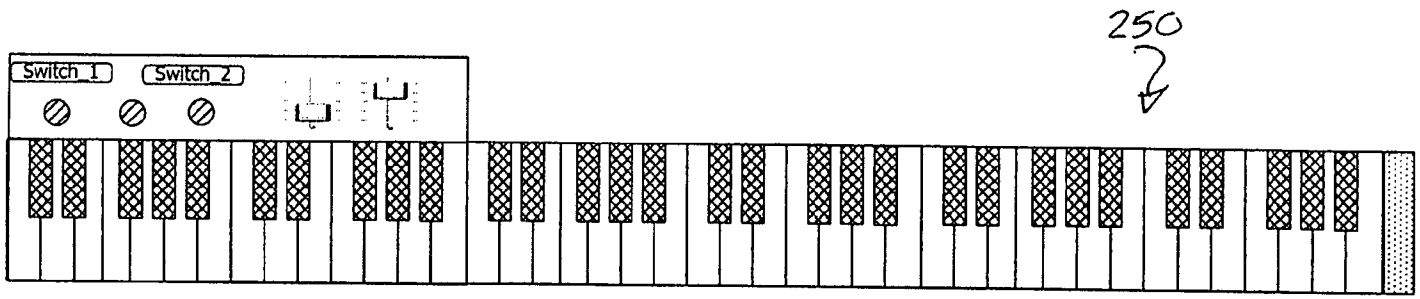
FIG. 3B illustrates another top view of the integrated keyboard of FIG. 3A.
Figure 3C:
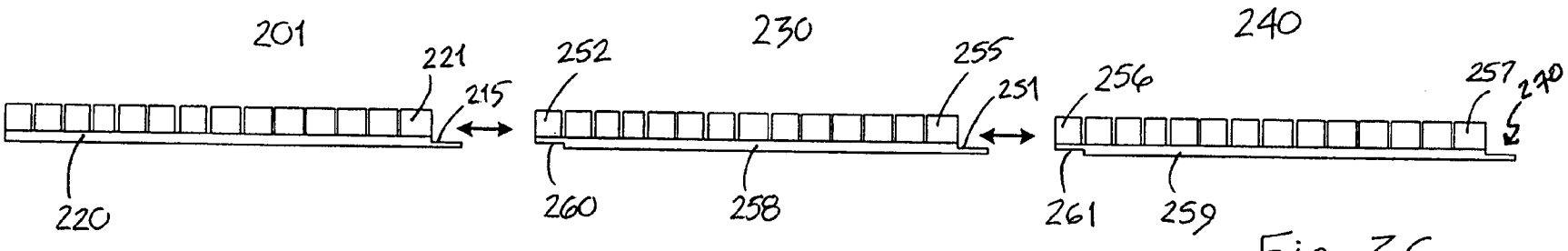
FIG. 3C illustrates a side view of the integrated keyboard of FIG. 3A.
Figure 3D:
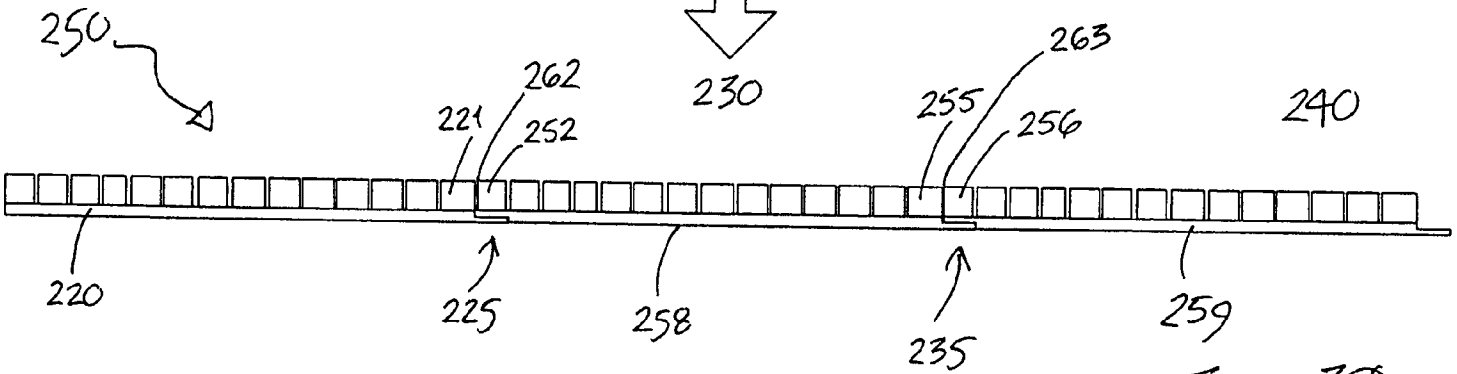
FIG. 3D illustrates another side view of an integrated keyboard of FIG. 3A.

FIGS. 3A-3B illustrate a top view and FIGS. 3C-3D illustrate a side view of first keyboard section 201, second keyboard section 230, and third keyboard section 240 coupled together (in the case of FIGS. 3B and 3D, or in the process of being coupled together) to form integrated keyboard 250. The coupling of the three keyboard section provides an integrated keyboard having at least 5 full octaves. The integration of three keyboard sections is merely exemplary, and in alternative embodiments, any number of keyboard sections may be coupled together. The manner of integration of keyboard sections as shown in FIGS. 3A-3D is also merely exemplary. When not in use, the three sections are completely detachable from each other, making the keyboard highly portable from one location to another and easy to store when not in use. Second keyboard section 230 and third keyboard section 240 are constructed similarly, in which base 258 of second keyboard section extends past the right-most key 255 to form space 251, and space 260 is formed under left-most key 252. The length and width dimensions of space 251 and 260 are substantially similar to key 255 and key 252, respectfully. Base 259 of third keyboard section 240 extends past right-most key 257 to form space 270, and space 261 is formed under left-most key 256. First keyboard section 202 can be considered the "main" keyboard section from which to expand upon to form a larger, integrated keyboard. As such, first keyboard section 202 includes various switches (e.g., 203, 204, 205), dials (e.g., 206, 207, 208), and sliders (e.g., 209, 210) to control various keyboard functions during operation, such as volume level, modulation, pitch bend and octave up/down and the other keyboard sections do not include such switches, dials, and sliders. In an alternative embodiment, switches, dials, and sliders can also be disposed on second keyboard section 230 and/or third keyboard section 240.

To form integrated keyboard 250, space 260 of second keyboard section 230 is positioned over space 215 of first keyboard section 201, and space 261 of third keyboard section 240 is positioned over space 251 of second keyboard section 230. The first coupled region 225 formed by first keyboard section 201 and second keyboard region 230 forms a spacing 262 between key 221 and key 252 that is substantially equivalent to the spacing between the keys within a keyboard section. Similarly, the second coupled region 235 formed by second keyboard section 230 and third keyboard section 240 forms a spacing 263 that is substantially equivalent to the spacing between the keys within a keyboard section. Because spacing 262 and spacing 263 have dimensions that are substantially consistent with each other and with all the other white keys of the keyboard, the user can expect key locations to be consistent within a keyboard section and from one keyboard section to another keyboard section. For example, when playing keys stretching an octave that includes keys from the first keyboard section 201 to the second keyboard section 230, the user experiences the same distance as an octave played within a keyboard section.

Integrated keyboard 250, in one embodiment, has a key pattern and fingering similar to traditional piano keyboards, providing familiarity to trained keyboardists, thereby requiring little relearning. Keyboard 250 also has a distinct tactile and visual pattern repeating at octave intervals to allow placement of a user's hands without looking at the keys. There are no repeats of a key corresponding to a note when one keyboard section is integrated with another keyboard section. For example in one embodiment, first keyboard section 201 begins with a key corresponding a "C" note near the left side and ends with a key corresponding to a "B" note near the right side. When second keyboard section 230 is integrated with first keyboard section 201, the left-most key 252 of second keyboard section 230 occupies space 215 so that the standard order of notes is maintained, because the "C" note follows the "B" note on a piano keyboard. The same order of notes is maintained when third keyboard section 240 is integrated with second keyboard section 230. Furthermore, the order of the sections may be automatically determined once they are interconnected together, so that they keys in each keyboard section are in the proper octave in an ordered series of octaves. Normally, the ordered series of octaves specifies that the leftmost keyboard section will include the lowest (in pitch) octave, and the rightmost keyboard section will include the highest (in pitch) octave, and there are a contiguous series of octaves from the lowest to the highest on the integrated keyboard formed from the combination of keyboard sections. In one embodiment, an octave span for keyboard 250 is about 160 mm to about 170 mm to allow the fingers to fit comfortably between keys and be familiar to trained keyboardists. In one particular embodiment, the octave span (e.g., from one C note to the next C note) is about 165 mm. The length of the white keys (e.g., keys 211, 212) and the length of the spaces (e.g., length 216 of space 215) can be between about 12 cm to about 15 cm, or about the standard length of white keys on conventional pianos. The length of the black keys (e.g., keys 213, 214) can be between about 8 cm to about 10 cm, or about the standard length of black keys on conventional pianos.

Figures 4A, 4B:
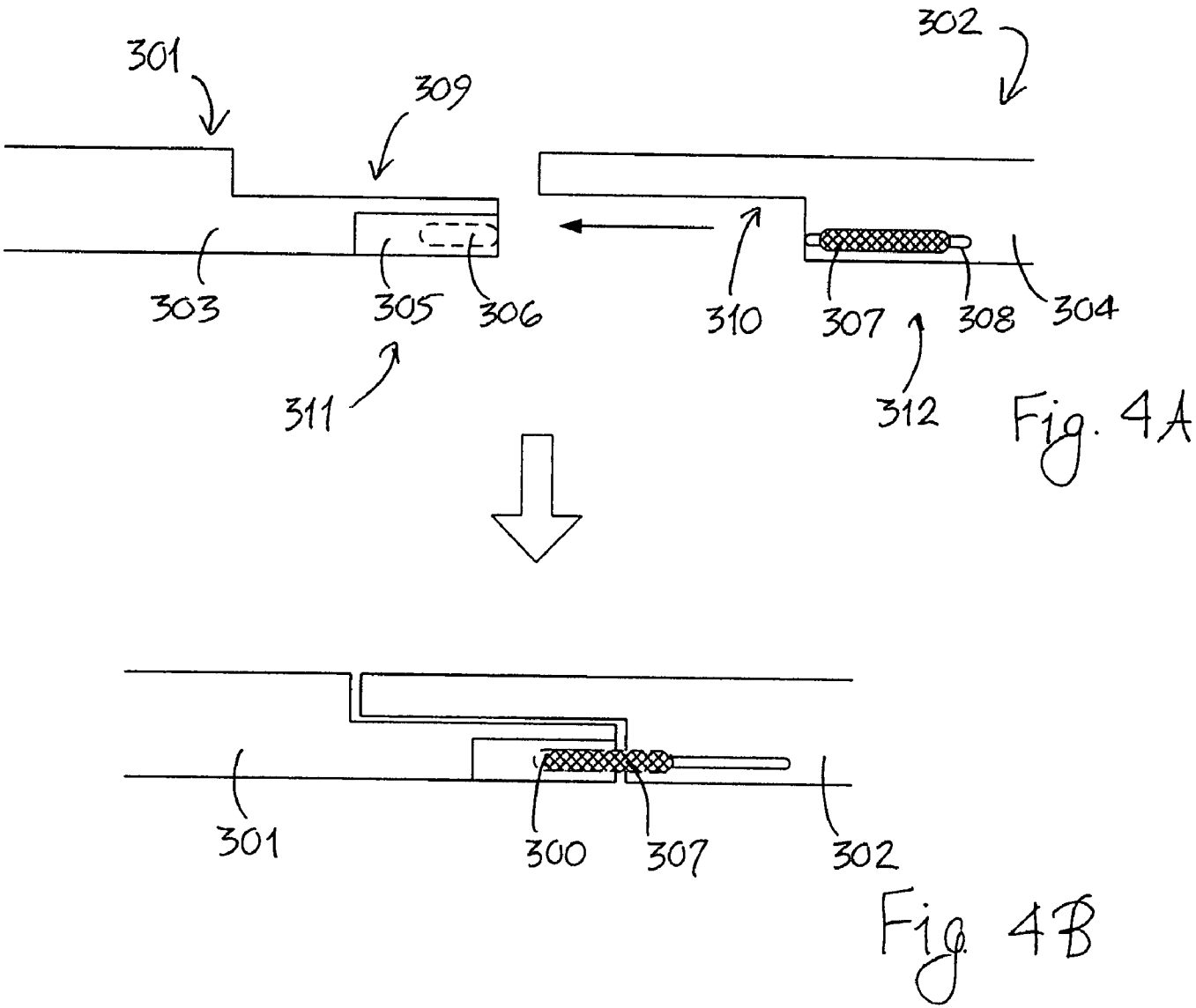
FIGS. 4A-4B illustrate one embodiment of a mechanism to secure a first keyboard section with a second keyboard section.

The various keyboard sections, when integrated together as described above (or when integrated together using other techniques), can be secured with various types of coupling mechanism such as a lock or latch. FIGS. 4A-4B illustrate one embodiment of a mechanism to secure first keyboard section 301 with second keyboard section 302. For clarity of explanation and to focus the description on the different coupling mechanisms, the keyboard sections are illustrated without key arrays (e.g., key array 202). In one embodiment, first keyboard section 301 and second keyboard section 302 are similar to first keyboard section 201 and second keyboard section 230 described above with respect to FIGS. 3A-3D. A space 309 is formed near a right side of base 303 of first keyboard section 301 that complements space 310 formed near a left side of base 304 of second keyboard section 302. A first portion 311 of a locking mechanism is disposed on base 303 that includes a receiver 305 with a slot 306 formed therein to receive a locking pin. A second portion 312 of the locking mechanism is disposed on base 304 that includes locking pin 307 that is slideable along a rail 308 in the direction of receiver 305. As illustrated in FIG. 4B, when first keyboard section 301 is integrated with second keyboard section 302, locking pin 307 slides into slot 306 to secure the two keyboard section together preventing the two keyboard sections from separating during use.

The locking pin mechanism is just one of several coupling mechanisms that may be used to secure keyboard sections together. In alternative embodiments, other types of locking/latching mechanisms can be integrated into the keyboard sections, such as latches, buckles, hook and loop fasteners, screws, and spring-loading pins. Whichever type of mechanism is used, the common feature, of at least certain embodiments, is that the keyboard sections can be separated from each other completely when not secured together.

Figure 5:
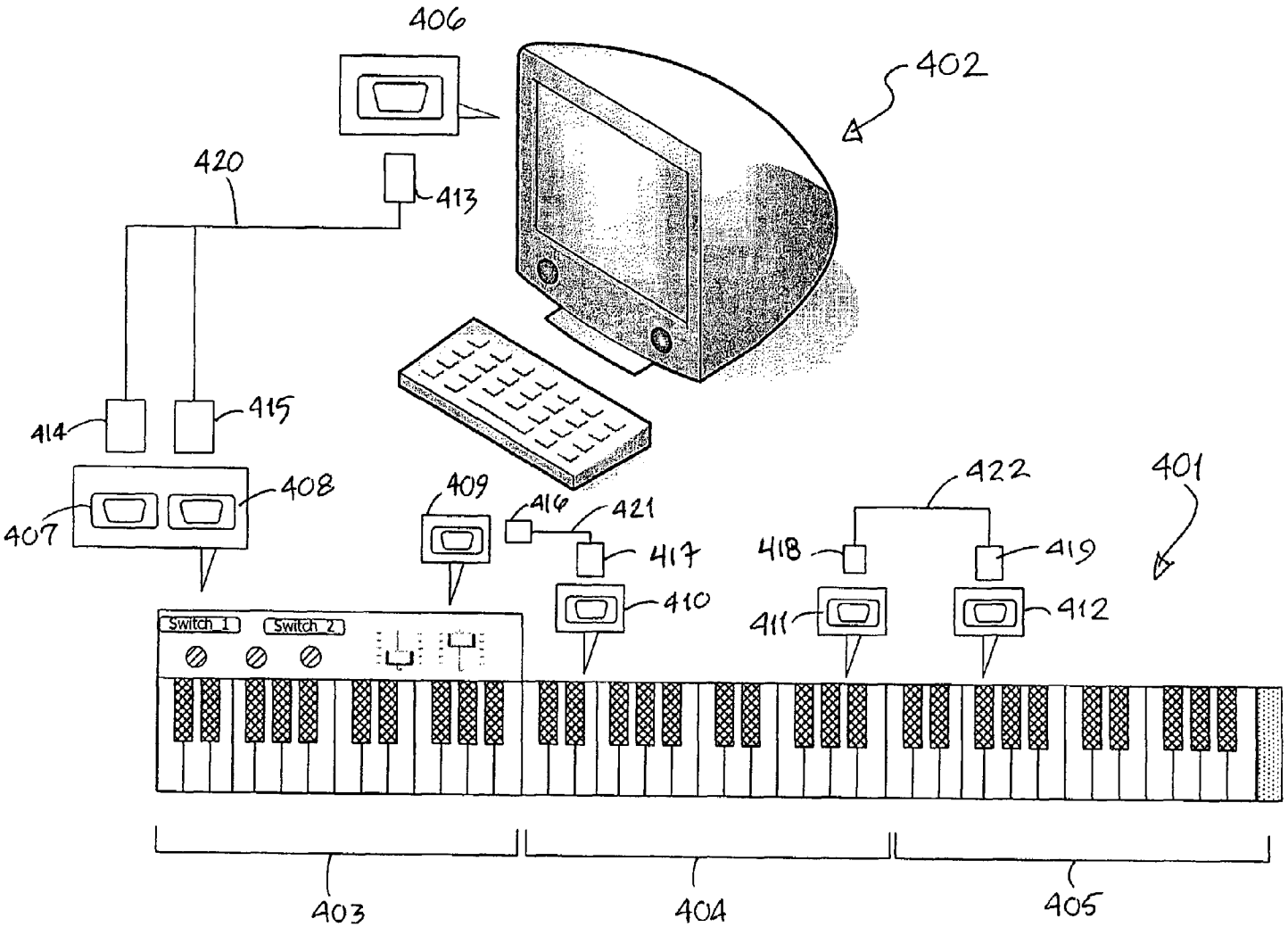
FIG. 5 illustrates one embodiment of a portable and expandable electronic keyboard configured with connectivity to a computer.

Embodiments of an integrated musical keyboard described (e.g., keyboard 250) may be stand-alone instruments which are capable of being used to play music (e.g., make sounds) without being connected to a data processing system such as a computer. In an alternative embodiment, the integrated keyboard can be a computer peripheral that communicates via a wired connection. FIG. 5 illustrates one embodiment of a portable and expandable electronic keyboard 401 configured with connectivity to a computer 402, which allows a user to utilize a range of interactive software executed on computer 402. Keyboard 401 integrates three keyboard sections, first keyboard section 403, second keyboard section 404, and third keyboard section 405 to form keyboard 401 as illustrated. Keyboard 401 can be integrated in a manner similar to that described above with respect to keyboard 250 or with alternative mechanical interconnection techniques and with a securing mechanism described above with respect to FIGS. 4A-4B or with alternative securing mechanisms. First keyboard section 403 includes connectivity ports 407, 408 to receive terminals 414, 415 of cable 420. In one embodiment, ports 407, 408 are compatible with Musical Instrument Digital Interface (MIDI) connectors, in which port 407 corresponds to a MIDI-In port and port 408 corresponds to a MIDI-Out port. Terminal 413 of cable 420 is a USB terminal that is received by USB compatible port 406 of computer 402.

The three keyboard sections are electrically connected through a series of cables in certain embodiments; in alternative embodiments, the keyboard sections may be directly connected, without cables, through mating connectors on the keyboard sections. In one embodiment, the keyboard sections are daisy-chained with USB cables. For example, first keyboard section 403 includes a USB port 409 to receive terminal 416 of cable 421, and second keyboard section 404 includes a USB port 410 to receive terminal 417. Similarly, terminal 418 of USB cable 422 is received by USB compatible port 411 of second keyboard section 405 and terminal 419 is received by port 412 of third keyboard section 405. In one embodiment, the USB compatible ports and cables can have certain properties to ensure proper electrical connectivity of the keyboard sections. For example, USB cable 421 can be a USB Type A-Type B in which terminals 416, 417 can be inserted into ports 409, 410 in only one orientation because of the difference in shape and size of the terminals. A similar configuration can be established for ports 411, 412.

In one embodiment, the two USB compatible ports on a keyboard section are not of the same type (i.e., port 410 is compatible with Type B and port 411 is compatible with Type A). Additionally, ports 409, 410 can be positioned near the backs of first keyboard section 403 and second keyboard section 404, respectively, such that cable 421 has a length customized to the distance between port 409 and port 410. Because of the relatively short length of cable 421, a user cannot properly connect a cable from port 410 to port 412. When the assembled keyboard 401 is connected to computer 402, the overall configuration of the key arrays from the three keyboard sections can be recognized by the software program executed on computer 402 through the wiring of cables 420, 421 and 422. For example, because cable 420 is directly connects first keyboard section 403 to computer 402, the left-most key from first keyboard section 403 is recognized as the first key in the overall key array. Similarly, the right-most key from third keyboard section 405 is recognized as the last key in the overall key array. As such, the total number of keys from the three key sections and the number of notes and octaves available for use are automatically determined. The order of the keyboard sections may be automatically determined, or manually set (e.g., by a user), once the keyboard sections are interconnected together, so that the keys in each keyboard section are in the proper octave in an ordered series of octaves. The following is one exemplary method for automatically determining the octaves. In the arrangement shown in FIG. 5, the leftmost section may be assigned a "0th" octave starting position by the computer 402; this "0th" octave may be higher than the lowest octave on a conventional 88-key piano. The port 409 may output a value which represents the starting position plus the number of octaves within the leftmost section. Each keyboard section may store a value, within non-volatile memory, which specifies the number of octaves within the keyboard section. In the example of FIG. 5, the port 409 may output a value of 0 (starting position) plus 2 (number of octaves within the section 403). The port 410 receives this value (2) and this value is added to the number of octaves within section 404 (to yield a value of 4), and the value 4 is output from port 411 to the next port 412 which receives the value 4. This automatic counting of octaves may occur upon initialization of the keyboard (e.g. when it is assembled together), and it may be performed, at least in part, by software drivers for the keyboard, which drivers are executing on the computer 402. The values which are passed from port to port are used to allocate the octaves, for each keyboard section, and these values may be transmitted back to the computer 402 which uses the values to decode the proper octave for each key within each section.

In alternative embodiments, wired keyboard 401 can be connected to other types of processing systems such as notebooks computers, workstations, handheld computers, cellular phones, personal digital assistants (PDAs), or any other type of hardware unit containing a processor that can execute a software program for interaction with keyboard 401. In another embodiment, keyboard 401 can communicate with computer 402 via wireless connectivity.

The connectivity of keyboard 401 to computer 402 is not limited to MIDI specific cables and ports. In alternative embodiments, first keyboard section 403 can be equipped with a USB-MIDI port so that a standard USB cable can be used to connect the two components. Although communication of keyboard 401 and computer 402 has been described with respect to the MIDI-based language, in alternative embodiments, other types of language protocols may be used for communication. The electrical connectively of the three keyboard sections are also not limited to a USB compatible format. Other types of data transfer standards can used such as the IEEE 1394 standard. It will also be appreciated that, in certain embodiments, the keyboard section may include internal electronics and one or more speakers such that the keyboard section may, without being connected to another device, play music.

In the foregoing specification, the invention has been described with reference to specific exemplary embodiments thereof. It will, however, be evident that various modifications and changes may be made thereto without departing from the broader spirit and scope of the invention as set forth in the appended claims. For example, in certain alternative embodiments, the base of a keyboard section may extend past the leftmost key (rather than the rightmost key) or the base may not extend on either side, but in each case, the sides of at least one of the leftmost key or the rightmost key are exposed to thereby allow the keyboard section to be joined to another keyboard section to create a larger, seamless keyboard without a frame significantly intervening between the adjoined keyboard sections. Further, the keyboard sections allow for the keyboard to be expandable and contractible. The specification and drawings are, accordingly, to be regarded in an illustrative rather than a restrictive sense.

What is claimed is:

1. A musical keyboard, comprising:

a base having a front side, a backside, a left side, a right side, a top side, and a bottom side; and a plurality of black-type and white-type piano keys disposed over said top side and arranged from said left side to said right side of said base beginning with a left-most key and ending with a right-most key, said left-most key and said right-most key having exposed sides, a portion of said base extending past said right-most key, said portion to form a first space having a length and a width substantially equal to said right-most key, wherein the exposed side on the left-most key is on a left-most side of the left most key, the left-most side being substantially perpendicular to the top side of the base, and wherein the exposed side on the right-most key is on a right most side of the right-most key, the right-most side being substantially perpendicular to the top side of the base, and wherein the first space allows a seamless integration of a second musical keyboard to allow a user of the keyboard to experience consistent spacing between all keys.

2. The musical keyboard of claim 1, further comprising a frame portion extending from said backside of said base while exposing said left-most key and said right most key.

3. The musical keyboard of claim 2, wherein a plurality of controller switches are disposed on said frame portion.

4. The musical keyboard of claim 1, wherein said plurality of black-type and white-type keys have dimensions that are substantially equal to standard piano keys.

5. The musical keyboard of claim 1, wherein an octave span formed by said plurality of black-type and white-type keys is about 160 mm to about 170 mm.

6. The musical keyboard of claim 1, wherein said first space formed by said base portion complements a left-most white key from a second musical keyboard.

7. The musical keyboard of claim 1, wherein an undercut is formed in the base near the left-most white key, said undercut having a length and a width substantially similar to a length and a width of the left-most white key.

8. The musical keyboard of claim 7, wherein said undercut forms a second space that complements a right-most key from a third musical keyboard.

9. The musical keyboard of claim 1, wherein said left-most white key comprises a C note and said right-most white key comprises a B note.

10. The musical keyboard of claim 1, wherein said plurality of black and white piano-type keys comprise at least 14 white keys and at least one octave.

11. A musical keyboard, comprising:

a first keyboard section comprising a first plurality of black-type and white-type piano keys disposed over a first base, said plurality of black-type and white-type piano keys arranged from a left side to a right side of said first base, a portion of said first base to extend past a right-most key, said portion to form a space having a length and width substantially equal to at least a portion of said right-most key; and a second keyboard section comprising a second plurality of black-type and white-type piano keys disposed over a second base, said plurality of black-type and white-type piano keys arranged from a left side to a right side of said second base, an undercut formed in said second base below a left-most key, said undercut having a length and width substantially equal to at least a portion of said left most key, wherein said space and said undercut complement each other to allow said left-most key from said second keyboard section to rest immediately adjacent to said right-most key from said first keyboard section to form a continuous array of black-type and white-type keys, wherein the left-most and right-most key have matching sides which are substantially parallel to the left side and right side of the first and second bases and to each other, and wherein the width of the undercut allows a joining of the first and section sections to allow a user to experience consistent spacing between all keys by providing the same distance between the left-most and right-most key as compared to the respective distances between the black or white keys within the first and second keyboard sections.

12. The musical keyboard of claim 11, wherein the matching sides have no portion of the first base and second base between them, and the musical keyboard further comprises a lock mechanism disposed on said first keyboard section and said second keyboard section, said lock mechanism to secure said first keyboard section and said second keyboard section when said first keyboard section is coupled to said second keyboard section.

13. The musical keyboard of claim 11, wherein said lock mechanism comprises a lock and pin.

14. The musical keyboard of claim 11, wherein said lock mechanism comprises a latch.

15. The musical keyboard of claim 11, wherein said first plurality of black-type and white-type piano keys and said second plurality of black-type and white-type piano keys rest flush with each other when joined.

16. The musical keyboard of claim 11, wherein said first and second plurality of black-type and white-type keys have dimensions that are substantially equal to standard piano keys.

17. The musical keyboard of claim 15, wherein said continuous array of black-type and white-type keys formed the by said first and second keyboard sections comprises a computer peripheral.

18. The musical keyboard of claim 16, wherein an octave span formed by said plurality of black and white keys is about 160 mm to about 170 mm.

19. An apparatus, comprising:

a first musical keyboard section and a second musical keyboard section to alternate between a portable configuration and an operating configuration, when in said portable configuration said first musical keyboard section and said second musical keyboard section are not coupled to each other to form an extended keyboard and when in said operating configuration said first keyboard section and said second keyboard section are coupled to each other, said operating configuration comprising:

a first plurality of keys disposed over a first base, said first base extending past a right-most key to form a space having a length and a width substantially similar to a left-most key from said second keyboard section, said space to receive said left-most key to allow keys from said first keyboard section to rest flush with keys from said second keyboard section to give the appearance of a single musical keyboard, wherein the width of the space allows a user in the operating configuration to experience consistent spacing between all keys by providing the same distance between the left-most and right-most key as compared to the respective distances between the black or white keys within the first and second keyboard sections.

20. The apparatus of claim 19, wherein an undercut is formed in said first base near a left-most key, said undercut having a length and a width substantially similar to a right-most key from a third keyboard section, said undercut to receive said right-most key to allow keys from said first keyboard section to rest flush with a third plurality of keys from said third keyboard section.

21. The apparatus of claim 19, wherein said first and second plurality of black and white keys have dimensions that are substantially equal to standard piano keys.

22. The apparatus of claim 19, further comprising a lock mechanism disposed on said first musical keyboard section and said second musical keyboard section, said lock mechanism to secure said first musical keyboard section and said second musical keyboard section when in said operating configuration.

23. A musical keyboard comprising:

a first musical keyboard section having a portion to couple with a second musical keyboard section, the first musical keyboard section having a plurality of keys including a leftmost key and a rightmost key, wherein at least one of the leftmost key and the rightmost key has an exposed side to allow another key to be disposed adjacent to the at least one of the leftmost key and the rightmost key; and wherein the first musical keyboard section is capable of alternating between a portable configuration, in which the first musical keyboard section is separate from and not coupled to the second musical keyboard section, and an operating configuration in which the first musical keyboard section is coupled to the second musical keyboard section, wherein the first musical keyboard section is at least partially frameless to provide the at least one exposed side, and wherein when the keyboard sections are coupled the exposed side allows a user in the operating configuration to experience consistent spacing between all keys by providing the same distance between the keys which are between the first and second musical keyboard sections, as compared to the distances between keys within the first and second keyboard sections.

24. A musical keyboard comprising:

a first musical keyboard section having a portion to couple with a second musical keyboard section, the first musical keyboard section having a plurality of keys including a left-most key and a right-most key, wherein at least one of the left-most key and the right-most key has an exposed side to allow another key, on the second musical keyboard section, to be disposed adjacent to the at least one of the left-most key and the right-most key; and wherein the first musical keyboard section is capable of alternating between a portable configuration, in which the first musical keyboard section is not coupled with the second musical keyboard section to form an extended keyboard, and an operating configuration in which the first musical keyboard section is coupled to the second musical keyboard section to form the extended keyboard, and wherein when the keyboard sections are coupled the exposed side allows a user in the operating configuration to experience consistent spacing between all keys by providing the same distance between the keys which are between the first and second musical keyboard sections, as compared to the distances between keys within the first and second keyboard sections.

25. The musical keyboard as in claim 24 wherein the exposed side is immediately adjacent to an exposed side of a key of the second musical keyboard section.

26. The musical keyboard as in claim 25 wherein the first musical keyboard section comprises a frame and wherein no part of the frame is between the exposed side and the exposed side of the key of the second musical keyboard section.

27. The musical keyboard as in claim 25 wherein the first musical keyboard section is at least partially frameless to provide the exposed side.

28. The musical keyboard as in claim 26 wherein at least a portion of the frame extends beyond the exposed side.

29. The musical keyboard as in claim 28 wherein the at least a portion of the frame is configured to complement a portion of another frame on the second musical keyboard section.

* * * * *